United States Patent [19]

Hix

[11] Patent Number: 4,949,954

[45] **Date of Patent: * Aug. 21, 1990**

[54] JOINTED BICYCLE-SIMULATION DEVICE FOR ISOMETRIC EXERCISE

[76] Inventor: William R. Hix, 2224 Davis Way, Modesto, Calif. 95351

[ * ] Notice: The portion of the term of this patent subsequent to Feb. 24, 2004 has been disclaimed.

[21] Appl. No.: 347,746

[22] Filed: May 4, 1989

[51] Int. Cl.[5] ..... A63B 21/00

[52] U.S. Cl. ..... 272/73; 272/126; 272/97

[58] Field of Search ..... 272/73, 126, 70, 97, 272/135, 142, 146, 69, 72, 125; 128/25 R

[56] References Cited

U.S. PATENT DOCUMENTS

| | | | |
|---|---|---|---|
| 2,603,486 | 7/1952 | Hughes | 272/73 |
| 2,772,881 | 12/1956 | Fundom | 128/25 B |
| 3,467,374 | 9/1969 | Auer | 272/57 |
| 3,566,861 | 3/1971 | Weiss | 272/73 |
| 4,300,760 | 11/1981 | Bobroff | 272/120 |
| 4,391,441 | 7/1983 | Simjian | 272/126 |
| 4,434,981 | 3/1984 | Norton | 272/97 |
| 4,451,033 | 5/1984 | Nestegard | 272/73 |
| 4,463,945 | 8/1984 | Spector | 272/73 |
| 4,645,200 | 2/1987 | Hix . | |

*Primary Examiner*—Stephen R. Crow
*Attorney, Agent, or Firm*—Thomas Schneck

[57] ABSTRACT

A bicycle-simulation exercise device for convalescing and handicapped persons having foot pedals and hand grips which all swing in an orderly fashion in directions not to place undue strain on the person's joints. The lower end of a first upwardly inclined leg-activated bar is pivotally connected to the lower end of a first upwardly inclined arm-activated bar. Adjacent these bars, second leg-activated and arm-activated bars are identically coupled. The two pivot points of the bars are attached to opposed ends of an elastomeric band which is trained about a pulley. In this manner, each of the four bars is mechanically coupled to the remaining bars. Two degrees of operating difficulty are provided by selective insertion of a rod into the pulley. With the rod removed from the pulley, the pulley is allowed to rotate with movement of the elastomeric band to make operation of the exercise device relatively easy. However, insertion of the rod into the pulley aperture locks the pulley and the frictional force created at the elastomeric band-to-pulley interface produces a greater resistance to bar movement.

17 Claims, 3 Drawing Sheets

JOINTED BICYCLE-SIMULATION DEVICE FOR ISOMETRIC EXERCISE

TECHNICAL FIELD

The present invention relates to portable exercise devices and particularly to foot and arm operated exercise devices.

BACKGROUND ART

Exercise devices for convalescing and handicapped persons are known. For example, U.S. Pat. No. 4,645,200 to Hix and 2,772,881 to Fundom teach exercising devices for persons in a seated position. The apparatus of Fundom includes a pair of pedals which can slide along a base, much like cross country skiing exercisers such as U.S. Pat. No. 4,434,981 to Norton. However, unlike Norton which includes simulated ski poles which are independent of foot-carrying platforms, Fundom includes arms which are mechanically connected to the pedals so that the force provided by an arm muscle can assist a leg muscle in sliding a pedal along the base. Other cross country skiing exercisers include U.S. Pat. No. 3,566,861 to Weiss which has upright levers pivotally attached both to a frame and to pedals, and 3,467,374 to Auer.

Hix teaches an isometric exercising device having J-shaped bars pivotally mounted to a frame. A cord is fastened to each of the bars and is laced through a pulley so that the bars move in opposed back-and-forth motion. Pedals on the bar follow this back-and-forth motion, as do handles at the upper extent of the J-shaped bars. Persons with only one strong leg can exercise a weak or paralyzed leg because the action of the strong leg on one pedal moves the weak leg on the opposite pedal Likewise, force exerted onto one of the pair of handles is translated to the other handle and to both pedals. Hix is, therefore, an improvement over bicycle exercising devices such as U.S. Pat. Nos. 4,300,760 to Bobroff, 4,451,033 to Nestegard and 4,463,945 to Spector.

Hix provides an exercise device which can be used by persons who are limited in the type of exercise that can be undertaken. It has been discovered, however, that for certain persons the path of arm motion is not an optimal path. The optimal path is one in which a minimum amount of strain is put on the user's joints and in which a weak or paralyzed limb can follow the path without a strong tendency to fall off or be pulled off a foot pedal or a handle.

An object of the present invention is to provide a bicycle-simulation device for exercise of both arm and leg muscles, with each limb following a smooth path of motion without undue strain. A further object is to provide such a device which can be easily manufactured without resort to specially made pedal bars.

DISCLOSURE OF THE INVENTION

The above objects have been met by an exercise device which operates in a manner which can best be described by envisioning a rectangular box, with the four corners representing the shoulder joints and the hip joints of the user. In the use of the exercise device, adjacent corners of the imaginary box never move in the same direction. That is, when a forward pressure is applied from a first hip joint, the second hip joint and the shoulder joint above the first hip joint are moved rearwardly. Diagonal corners of the imaginary box, however, do act together. Undue strain is avoided by a generally linear motion of a user's legs along a path directed toward and away from the user's chest, thereby permitting a "folding" of the imaginary box to accommodate opposed motion of adjacent corners, rather than a more strainful motion directly at the lower corners, or hip joints.

The exercise device is a bicycle-simulation device for persons in a seated position and includes a frame, or housing, which slidably receives a plurality of bars. A first upwardly inclined leg-activated bar has a foot pedal at an upper end and is pivotally attached at a lower end to a first upwardly inclined arm-activated bar. In identical manner, a second upwardly inclined leg-activated bar is attached to a second arm-activated bar. The upper ends of the arm-activated bars are bent to provide handles. Thus, each of the connections of an arm-activated bar to a leg-activated bar is a separate pivot axis which is caused to swing as pressure is exerted onto one or both of the bars associated with the pivot axis. Apertures within the housing slidably receive the bars, so that placement of the apertures determine the path of the bars as pivoting takes place.

A belt is looped around a guide fixed to the housing. The opposed ends of the belt are attached to the pivot axis. Thus, the exercise device uses an isometric principle of exercise in which one group of muscles opposes the efforts of others. When one foot pedal is pushed in one direction, the other pedal is forced in the opposite direction. Opposite handles also move in opposite directions. Moreover, the arm-activated bars may be used to assist the exercising of weak or partially paralyzed legs. Pulling back on the left handle, for example, pushes in the left pedal and forces out the right pedal. Preferably, the guide is a pulley and the belt is an elastomeric band to provide a high coefficient of friction. A manually operated lock can selectively prevent rotation of the pulley. In this manner, two degrees of difficulty are provided, with easy operation being associated with free rotation of the pulley and the more difficult operation being a result of the movement of the elastomeric band relative to a stationary pulley.

An advantage of the present invention is that a less strainful exercise device is available to convalescing and handicapped persons. Another advantage is that the degree of difficulty can be selected. Moreover, the linear arm-activated bars and leg-activated bars facilitate easy manufacture.

BEST MODE FOR CARRYING OUT THE INVENTION

Figure 1:
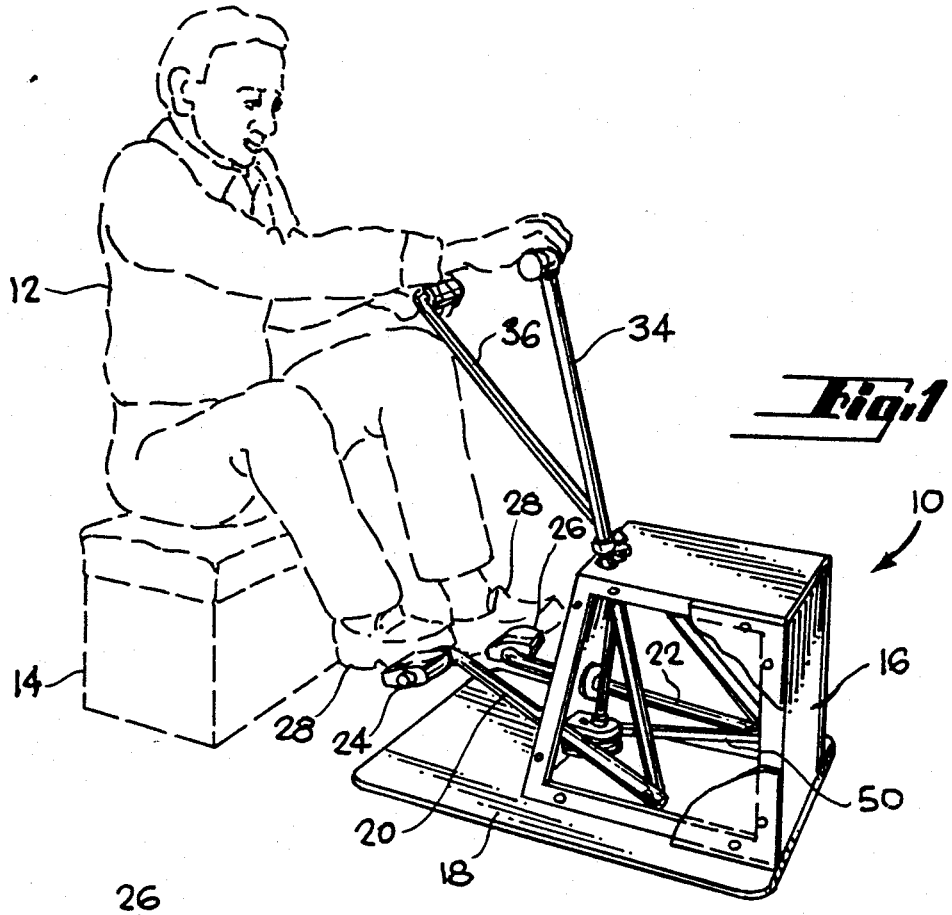
FIG. 1 is a perspective view of an exercise device in accord with the present invention.

With reference to FIG. 1, a bicycle-simulation exercise device 10 is shown for use by a person 12 in a seated position. The exercise device 10 is particularly adapted for handicapped and convalescing persons who might otherwise have difficulty in engaging in exercise that can strengthen muscles without discomfort. The person 12 is shown sitting on a footstool 14, but the exercise device 10 can be utilized from a wheelchair or chair of the person's choice.

Figure 2:
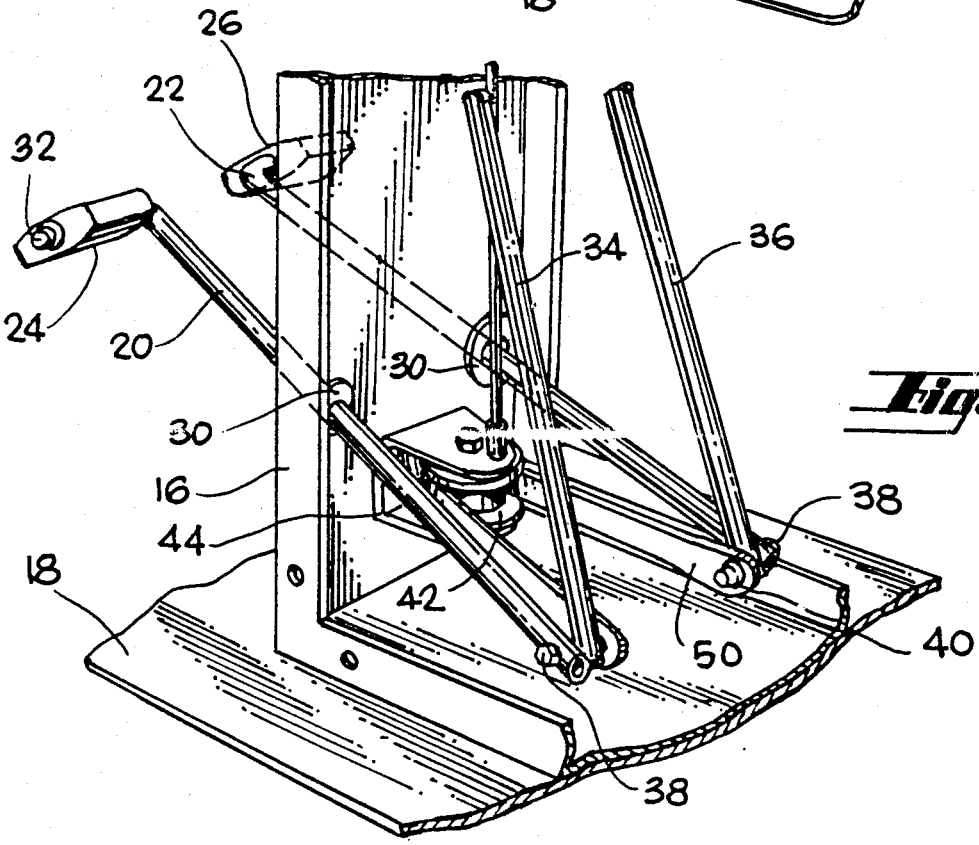
FIG. 2 is a detail of a portion of the exercise device shown in FIG. 1.

The bicycle-simulation exercise device 10 includes a boxlike frame 16, or housing, mounted on a base 18. The base is generally flat and acts to stabilize the exercise device. As shown in FIGS. 1 and 2, a pair of leg-activated bars 20 and 22 are slidably received within the housing 16. The leg-activated bars 20 and 22 are linear members which each terminate at an upper extent in a foot pedal 24 and 26.

The foot pedals 24 and 26 extend perpendicularly outward from the leg-activated bars 20 and 22. The feet 28 of a person 12 are placed on the foot pedals and pushed alternatively back and forth in a gentle swinging motion. The foot pedals are typically made of material such as rubber which aids in preventing the person's feet 28 from accidentally slipping from the foot pedals. The foot pedals may optionally be equipped with stirrups, not shown, to maintain the person's feet in place. The legactivated bars 20 and 22 are preferably metal, but may be made of some other strong-durable material.

The leg-activated bars 20 and 22 are slidably received by grommets 30 placed within apertures of the housing 16. The mechanical attachment provides a back-and-forth motion which may be described as a generally linear motion toward and away from the chest of the person 12. The foot pedals 24 and 26 are rotatably mounted on spindles 32 to accommodate normal movement of the person's feet 28.

At the lower end of the leg-activated bars 20 and 22, each bar is pivotally attached to an arm-activated bar 34 and 36. Each of the bars 20, 22, 34 and 36 is an upwardly inclined bar pivotally attached to a second bar at a lowermost extent. The fastening arrangement is shown as a bolt 38 which passes through apertures in the associated bars and which is retained in place by a washer and lock nut 40. Other fastening arrangements may also be used, provided that a leg-activated bar 20 and 22 is allowed to pivot relative to the associated arm-activated bar 34 and 36.

Figures 3, 4:
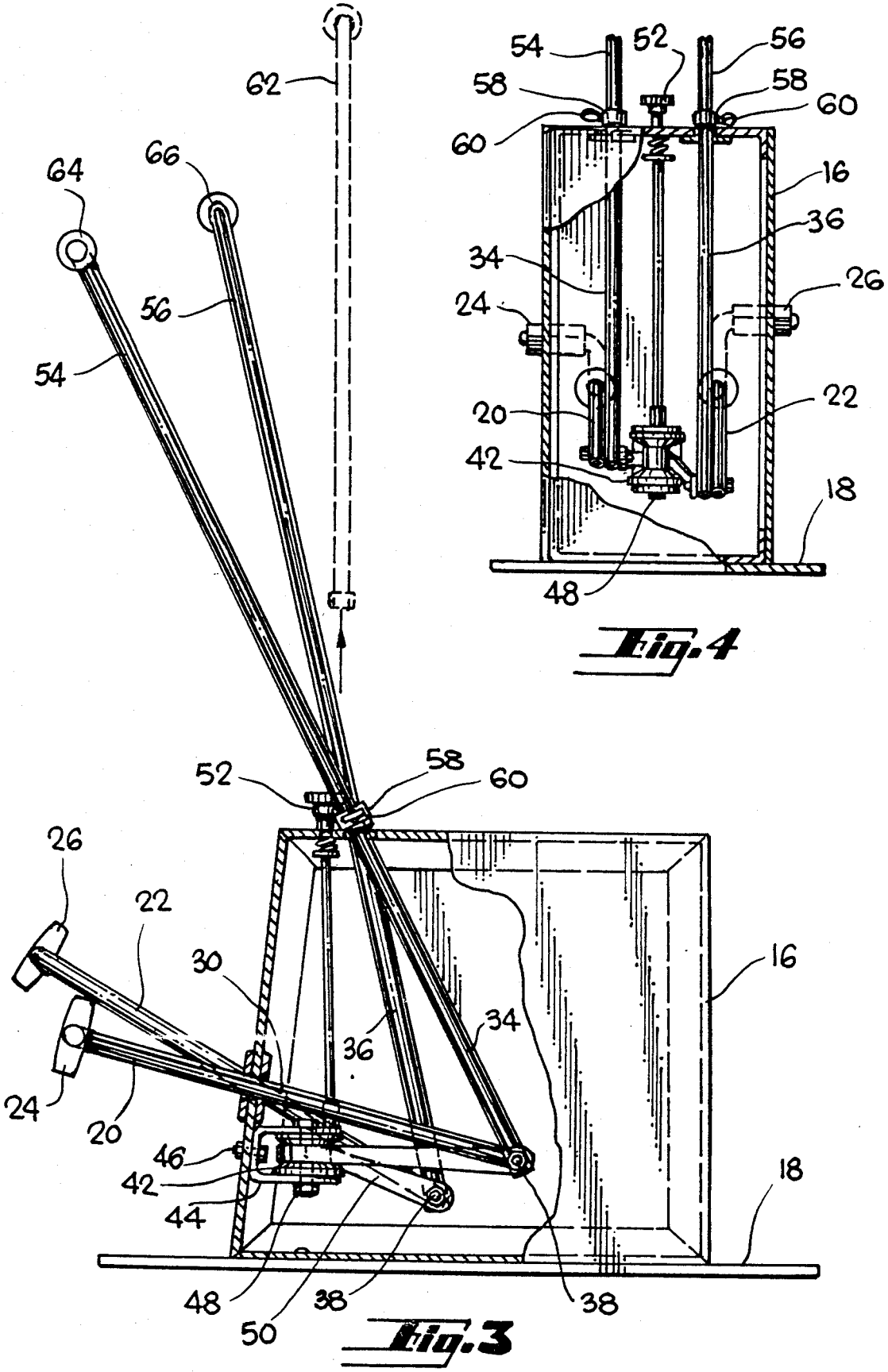
FIG. 3 is a side view of the exercise device of FIG. 1.
FIG. 4 is a front view of the exercise device of FIG. 3.

Referring now to FIGS. 2–4, a pulley 42 is secured to the housing 16 by a C-shaped bracket 44. The C-shaped bracket 44 is fixed to the housing by a bolt 46. The pulley 42 is located between the leg-activated bars 20 and 22 and, as will be explained more fully below, may be locked in place or permitted to rotate above a vertical shaft 48.

A belt 50 is fastened at one end to the pivot axis of leg-activated bar 20 and arm-activated bar 34. The opposite end of the belt 50 is fixed at a pivot axis of the leg-activated bar 22 and arm-activated bar 36. The belt 50 is trained about the pulley 42 and bolts 38 secure the opposed ends of the belt to the respective pivot axis. The term "belt" is used here as a general term for a cable, wire, cord, rope, string, band, line or chain that may be used in connection with a pulley. An elastomeric band is preferred for its durability and for its high coefficient of friction. By utilizing a locking mechanism 52, the pulley 42 can be selectively prevented from rotating about the shaft 48. Utilizing a belt which provides a high coefficient of friction ensures that there are two significantly different degrees of operating difficulty. Movement of an elastomeric band against a pulley in a locked condition, is significantly more difficult than movement of an elastomeric band against a freely rotatable pulley. Because the high coefficient of friction is a highly desirable feature of the present invention, the belt 50 will hereinafter be referred to as an elastomeric band.

As best seen in FIGS. 3 and 4, the armactivated bars 34 and 36 have a two-piece construction. A first piece is almost entirely contained within the housing 16, while an upper piece 54 and 56 of each of the bars is telescopically attached at the exterior of the housing. A sleeve 58 at the lowermost extent of the upper piece 54 and 56 includes an internally-threaded bore to receive a thumbscrew 60. The upper piece has a diameter to receive a portion of the lower piece and the thumbscrew 60 is tightened to fasten the pieces together. FIG. 3 illustrates an upper piece 62 removed from an armactivated bar 34 and 36.

Each arm-activated bar 34 and 36 terminates in a handle 64 and 66 extending perpendicularly outwardly for grasping by a person. Because the elastomeric band 50 links the pivot axes at bolts 38, the leg-activated bars 20 and 22 and the arm-activated bars 34 and 36 act in unison. For example, an inward pull of the handle 66 causes the associated leg-activated bar 22 to retract into the housing 16 and causes the adjacent bars 20 and 34 to undergo a pivot opposite of that of bars 22 and 36.

Figure 5:
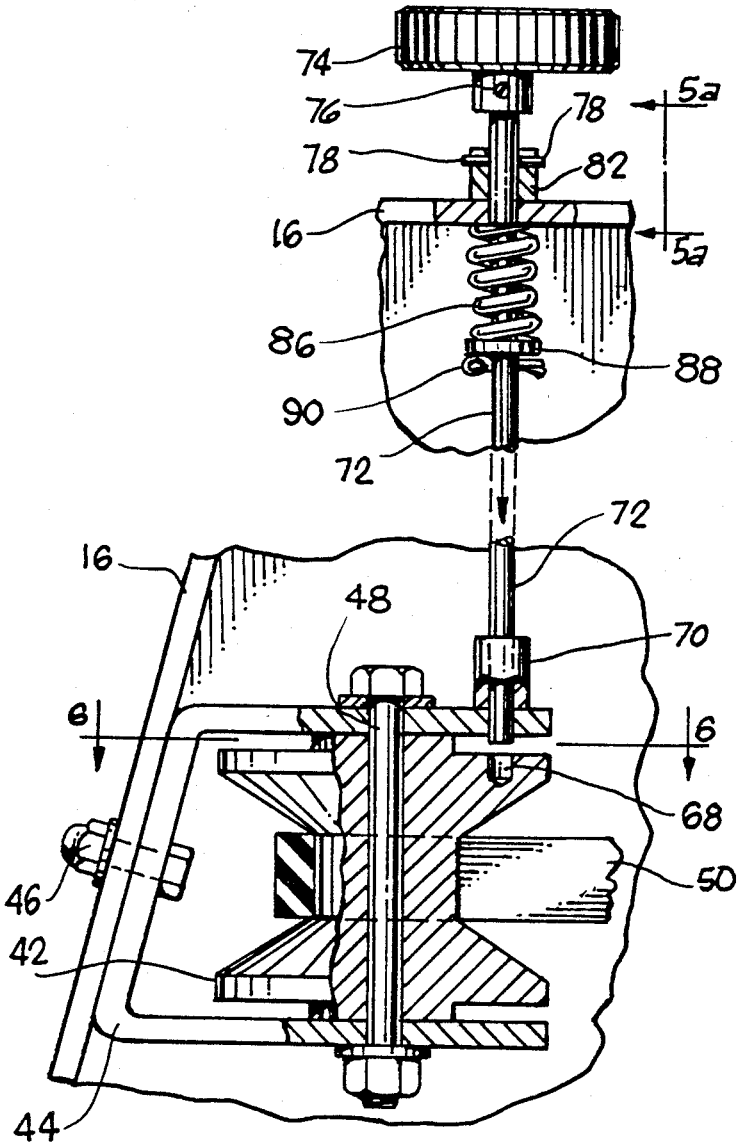
FIG. 5 is a side view of a portion of the exercise device of FIG. 3.
Figure 6:
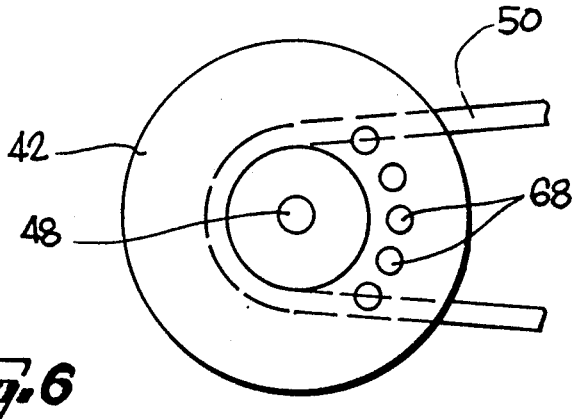
FIG. 6 is a top view of the pulley of FIG. 5 taken along lines 6–6.

As noted above, the degree of difficulty of bar movement may be varied by selectively locking the pulley 42. The locking mechanism is shown in FIGS. 5–6. The pulley 42 has a plurality of apertures 68 in the top surface. The series of apertures may be limited to the normal range of pulley motion as shown in FIG. 6, but preferably the apertures are located about the entirety of the pulley. At the top of the C-shaped bracket 44 which secures the pulley is a sleeve 70 which acts to seat a locking shaft 72. The locking shaft passes through the sleeve 70 and through a bore in the C-shaped bracket 44. When pressed downwardly from the position shown in FIG. 5, the locking shaft is inserted into one of the apertures 68 in the pulley. Thus, the locking shaft is shown in an unlocked position, but can be moved to a locked position by pressing the shaft into an aperture 68. In the unlocked position the pulley is freely rotatable, as the shaft 72 does not restrict rotation.

A disk-shaped knob 74 is secured to the locking shaft 72 by a setscrew 76. Directly below the diskshaped knob is a pair of horizontal pins 78 that are integral with the locking shaft 72. In the locked position shown in FIGS. 5 and **5*a*, the pins 78 rest within minor grooves 80 of a positioning member 82. In such a position, the locking shaft 72 is maintained above the level of the pulley 42. However, the disk-shaped knob 74 may be lifted, rotated ninety degrees, and then lowered so that horizontal pins 78 fit within major grooves 84 shown in FIG. 5*b***. In this second position, the locking shaft fits within one of the pulley apertures.

Whether the horizontal pins 78 are inserted into the minor grooves 80 or the major grooves 84, the horizontal pins are biased to remain in the grooves by a helical spring 86. The helical spring is trapped between the housing 16 and a washer 88 which, in turn, is trapped between the helical spring and a cotter pin 90.

In operation, as shown in FIGS. 1 and 2, a user 12 applies pressure on a foot pedal 24 causing the associated leg-activated bar 20 to slide within the housing 16. Movement of the bar 20 causes both a pivoting with respect to the arm-activated bar 34 and a drawing of the elastomeric band 50 against the pulley 42. The elastomeric band is attached to both of the two pivot axes at bolts 38, so that as the elastomeric band is drawn across the pulley, the opposed bars 22 and 36 act in a manner opposite of bars 20 and 34.

Thus, pushing on foot pedal 24 brings the opposite foot pedal 26 toward the chest of the user 12. The bicycle-simulation exercise device 10 can be operated solely by a person's legs or by all four limbs in a coordinated motion. If one leg is weak or paralyzed, pushing on a foot pedal with the good leg forces the other foot pedal in the opposite direction. The weakened leg then suppresses the foot pedal either by its own weight or with the help of one or both of a person's hands applying force to the arm-activated bars 34 and 36. If both legs are weak or paralyzed, the exercise device 10 can be operated solely with the person's hands. Convalescing persons, such as stroke victims, can then use the exercise device to prevent muscles from atrophying.

Because the arm-activated bars 34 and 36 are pivotally connected to the leg-activated bars 20 and 22, the grommets 30 through which the leg-activated bars pass from the housing 16 can be positioned to provide a range of motion which prevents undue strain upon the hip joints and shoulder joints of the user. Preferably, the upwardly extending leg-activated bars direct the foot pedals 24 and 26 toward and away from the user's chest.

Figure 5A:
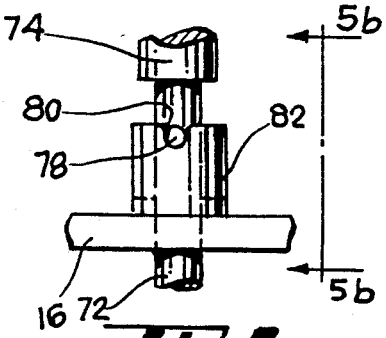
FIG. 5*a* is a front view of the locking mechanism of FIG. 5 taken along lines 5*a*–5*a*.
Figure 5B:
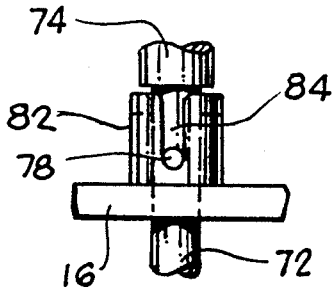
FIG. 5*b* is a side view of the locking mechanism of FIG. 5*a* taken along lines 5*b*–5*b*.

Depending upon the abilities of the user, a person may desire a greater or lesser degree of operating difficulty. FIGS. 5 and 5*a* illustrate the locking mechanism of the exercise device in a position to permit relatively easy operation. In this position, the locking shaft 72 is held above the aperture 68 in the pulley 42. Thus, the pulley is allowed to rotate freely. The back-and-forth motion of the elastomeric band 50 is matched by the motion of the pulley. However, the disk-shaped knob 74 may be lifted and rotated ninety degrees and then released so that the horizontal pins 78 extending from the locking shaft 72 fit within the major groove 84, as shown in FIG. 5*b*. The locking shaft 72 is thereby permitted to enter a pulley aperture 68 so as to prevent pulley rotation. In the locked position the pulley-to-band interface provides a relatively high frictional force during operation of the exercise device.

I claim:

1. A bicycle-simulation device to provide exercise for a user in a seated position comprising, a frame, a first upwardly inclined leg-activated bar movably attached to said frame, said first leg-activated bar having a first foot-supporting means at an upper end thereof, a first upwardly inclined arm-activated bar having a first hand-gripping means at an upper end, said first arm-activated bar and said first leg-activated bar being attached at a first pivot axis distal said first hand-gripping means and foot-supporting means, a second upwardly inclined leg-activated bar movably attached to said frame, said second leg-activated bar having a second foot-supporting means at an upper end thereof, a second upwardly inclined arm-activated bar having a second hand-gripping means at an upper end, said second arm-activated bar and leg-activated bar being attached at a second pivot axis, and bar coupling means for providing concurrent opposing swing motion of said first and second pivot axes relative to said frame, said bar coupling means including a belt and including a guide mounted to said frame, said belt having an end coupled to said attached first arm-activated and leg-activated bars and having a second end coupled to said attached second arm-activated and leg-activated bars, said belt having a midportion laced about said guide, thereby causing a swinging movement of each of said bars and causing pivoting at each of said first and second axes upon application of force onto any one of said bars.

2. The device of claim 1 wherein said frame is a housing having a plurality of apertures to receive said bars, each of said bars being slidably received at said apertures.

3. The device of claim 2 wherein the portion of each bar housed within said frame is a linear portion.

4. The device of claim 1 wherein said belt is an elastomeric band and wherein said guide is a pulley having a vertical axis.

5. The device of claim 4 further comprising manually operable means for selectively locking said pulley in position to prevent rotation about said vertical axis to provide two degrees of difficulty.

6. The device of claim 5 wherein said locking means includes an aperture in said pulley and a locking rod movably inserted into said aperture to prevent said rotation.

7. The device of claim 4 wherein said opposed ends of said elastomeric band are respectively fixed to said first pivot axis and said second pivot axis.

8. A bicycle-simulation device to provide exercise for a user in a seated position comprising, a frame, a first pair of pivotally connected, upwardly extending longitudinal bars, each bar having a midportion slidably coupled to said frame and having a lower end joined to the other bar of said first pair of bars at a first pivot axis, said first pair of bars defining an acute angle at said first pivot axis, a second pair of upwardly extending longitudinal bars adjacent said first pair, each having a midportion slidably coupled to said frame and having a lower end joined to the other bar of said second pair of bars at a second pivot axis to define an acute angle, said second pivot axis being parallel said first pivot axis, one of said bars of each pair of bars having an upper end terminating in a foot pedal and the other bar of each pair of bars terminating in a handle, a pulley mounted to said frame, and an elastomeric band tensioned about said pulley, said elastomeric band having a first end fixed to said first pair of bars at said first pivot axis and having a second end fixed to said second pair of bars at said second pivot axis, thereby causing a swinging movement of each of said bars and a pivoting at each of said first and second pivot axes upon application of force onto any one of said bars.

9. The device of claim 8 further comprising manually operable means for locking said pulley, said pulley being rotatably mounted to said frame, said means for locking selectively impeding rotation.

10. The device of claim 9 wherein said pulley has an aperture and said locking means includes a pin removably inserted into said aperture to prevent said rotation, thereby providing a degree of difficulty exceeding the degree of difficulty provided by a freely rotating pulley.

11. The device of claim 8 wherein said handles extend in a direction generally parallel to said first and second pivot axes.

12. The device of claim 8 wherein said frame is a housing, each bar being slidably received within an aperture of said housing for reciprocatory swinging motion of said foot pedals and handles, said bars of a pair of bars being attached within said housing.

13. The device of claim 12 wherein those portions of said bars that are within said housing are all straight portions.

14. A bicycle-simulation device comprising, a housing having a base for placement on a floor, first and second adjacent linear bars, each having a lower end slidably received within said housing and having an upper end terminating in a foot pedal, third and fourth linear bars, each having a lower portion received within said housing, the lower ends of said first and third bars being pivotally attached at a first axis, the lower ends of said second and fourth bars being pivotally attached at a second axis, said third and fourth bars each having an upper end terminating in a hand-gripping means, a pulley mounted to said frame, said pulley having a pulley axis extending generally vertical in direction, and a belt frictionally trained about said pulley, said belt having opposed ends fixed to said first and second axes, thereby causing opposed back-and-forth swinging motion of said first and second bars and of said third and fourth bars upon movement of any one of said bars.

15. The device of claim 14 wherein said belt is an elastomeric band.

16. The device of claim 14 further including means to selectively release said pulley for rotation about said pulley axis, thereby providing a selection of two degrees of difficulty.

17. The device of claim 14 wherein each of said first and second bars are slidably received by grommets within said housing.

* * * * *

UNITED STATES PATENT AND TRADEMARK OFFICE

CERTIFICATE OF CORRECTION

PATENT NO. : 4,949,954

DATED : August 21, 1990

INVENTOR(S) : William R. Hix

It is certified that error appears in the above-identified patent and that said Letters Patent is hereby corrected as shown below:

Column 3, line 30, "legactivated bars" should read
- - leg-activated bars - -.

Column 4, line 12, " armactivated bar" should read
- - arm-activated bar - -.

Column 4, line 22, "armactivated bar" should read
- - arm-activated bar - -.

Column 4, line 52, "diskshaped knob" should read
- - disk-shaped knob - -.

Signed and Sealed this

Twenty-sixth Day of April, 1994

*Attest:*

*Attesting Officer*

BRUCE LEHMAN

*Commissioner of Patents and Trademarks*